US005389956A

United States Patent [19]

Hadimioglu et al.

[11] Patent Number: 5,389,956

[45] Date of Patent: Feb. 14, 1995

[54] TECHNIQUES FOR IMPROVING DROPLET UNIFORMITY IN ACOUSTIC INK PRINTING

[75] Inventors: Babur B. Hadimioglu, Mountain View; Butrus T. Khuri-Yakub, Palo Alto; Richard L. Weisfield, Menlo Park; Eric G. Rawson, Saratoga, all of Calif.

[73] Assignee: Xerox Corporation, Stamford, Conn.

[21] Appl. No.: 931,804

[22] Filed: Aug. 18, 1992

[51] Int. Cl.[6] ..... B41J 2/04

[52] U.S. Cl. ..... 347/12

[58] Field of Search ..... 346/1.1, 140 R, 154; 340/825.79; 347/12, 13

[56] References Cited

U.S. PATENT DOCUMENTS

| | | | |
|---|---|---|---|
| 4,308,547 | 12/1981 | Lovelady et al. | 346/140 R |
| 4,697,195 | 9/1987 | Quate et al. | 346/140 R |
| 4,750,010 | 6/1988 | Ayers et al. | 346/107 R |
| 4,782,350 | 11/1988 | Smith et al. | 346/140 R |
| 5,028,937 | 7/1991 | Khuri-Yakub et al. | 346/140 R |
| 5,206,667 | 4/1993 | Yano | 346/140 R |
| 5,212,497 | 5/1993 | Stanley et al. | 346/1.1 |

FOREIGN PATENT DOCUMENTS 61-118261 6/1986 Japan .

*Primary Examiner*—Benjamin R. Fuller
*Assistant Examiner*—Alrick Bobb
*Attorney, Agent, or Firm*—John M. Kelly

[57] ABSTRACT

Techniques for improving droplet uniformity in acoustic ink printing. Row to row variations in an average droplet characteristic are reduced by controlling the electric power applied to the droplet ejectors of the individual rows. By applying the proper power to each row, the average droplet characteristic from the individual rows are made substantially. Another technique varies the efficiency of the individual droplet ejectors by physically trimming (such as with a laser) one or more of its components. Trimming may be performed on a droplet ejector's transducer, varactor, one or more associated resistors, or one or more capacitors. Yet another technique controls droplet ejector efficiency by electrically controlling the capacitance of a varactor associated with each droplet ejector, and thus each droplet ejector's efficiency. The voltage applied to each varactor may be controlled as a function of its column (to improve column to column uniformity), row (to improve row to row uniformity) or as a function of its column and row (to control the efficiency of the individual droplet ejector).

10 Claims, 4 Drawing Sheets

TECHNIQUES FOR IMPROVING DROPLET UNIFORMITY IN ACOUSTIC INK PRINTING

The present invention relates to techniques for improving droplet uniformity in acoustic ink printing.

BACKGROUND OF THE PRESENT INVENTION

Because acoustic ink printing (AIP) avoids the clogging and manufacturing problems associated with drop-on-demand, nozzle-based ink jet printing, it represents a promising direct marking technology. While more detailed descriptions of the AIP process can be found in U.S. Pat. Nos. 4,308,547, 4,697,195, and 5,028,937, essentially, bursts of focused acoustic energy eject droplets from the free surface of a liquid onto a recording medium. By controlling the ejection process as the recording medium moves relative to droplet ejection sites, a predetermined image is formed.

To be competitive with other printer types, acoustic ink printers must produce high quality images at low cost. To meet such requirements it is advantageous to fabricate print heads with a large number of individual droplet ejectors using techniques similar to those used in semiconductor fabrication. While specific AIP implementations may vary, and while additional components may be used, each droplet ejector will include an ultrasonic transducer (attached to one surface of a body), a varactor for switching the droplet ejector on and off, an acoustic lens (at the opposite side of the body), and a cavity holding ink such that the ink's free surface is near the acoustic focal area of the acoustic lens. The individual droplet ejectors are beneficially interconnected to form a matrix array such that the selection of an individual droplet ejector is possible by selection of its associated row and column.

As may be appreciated, acoustic printing is subject to a number of manufacturing variables, including the thicknesses and stresses on the ultrasonic transducers, electromagnetic reflections on the transmission lines, variations in acoustic coupling efficiencies, and variations in the components associated with each transducer. Because of manufacturing constraints, these variables cannot be controlled sufficiently to produce uniform droplets. The result is non-uniform droplets, i.e., droplets that vary in size, ejection velocity, and/or other characteristics. Non-uniform droplet size produces undesirable intensity variations in the final image, while non-uniform droplet ejection velocity produces misaligned droplets. Non-uniform droplets may degrade the final image so much that it becomes unacceptable. Therefore, a need exists for techniques that improve the droplet uniformity in acoustic ink printing.

SUMMARY OF THE INVENTION

Therefore, in accordance with the present invention there are provided techniques for improving the droplet uniformity in acoustic ink printing. One technique compensates for row to row variations in the average droplet uniformity by row-wise control of the electric power applied to the transducers. The power applied to each row is adjusted so as to achieve a uniform average droplet characteristic from each row.

Another technique for improving droplet uniformity is to vary the efficiency of the individual droplet ejectors by physically trimming (such as with a laser) one or more of their associated components. Specifically, this may be accomplished by physically trimming the dimensions of the individual transducers, varactors, one or more resistors, or one or more capacitors. Components may be included in the basic droplet ejector specifically for trimming.

Yet another technique for improving droplet uniformity is to control the voltage applied to the varactors of the droplet ejectors. By adjusting the varactor voltage applied to each column (row) as a function of that column's (row's) average droplet characteristic, uniform average droplets can be produced by each column (row). Alternatively, by controlling the varactor voltage applied to each droplet ejector that is ejecting a droplet, substantially uniform droplets can be achieved from each droplet ejector. Beneficially, the varactor voltages are obtained via digital-to-analog (D/A) converters controlled by memory devices that store the proper codes for the D/A converters to produce their required voltages.

BRIEF DESCRIPTION OF THE DRAWINGS

Other aspects of the present invention will become apparent as the following description proceeds and upon reference to the drawings, in which.

Note that in the drawings like references designate similar elements.

DETAILED DESCRIPTION OF THE ILLUSTRATED EMBODIMENTS

Figure 1:
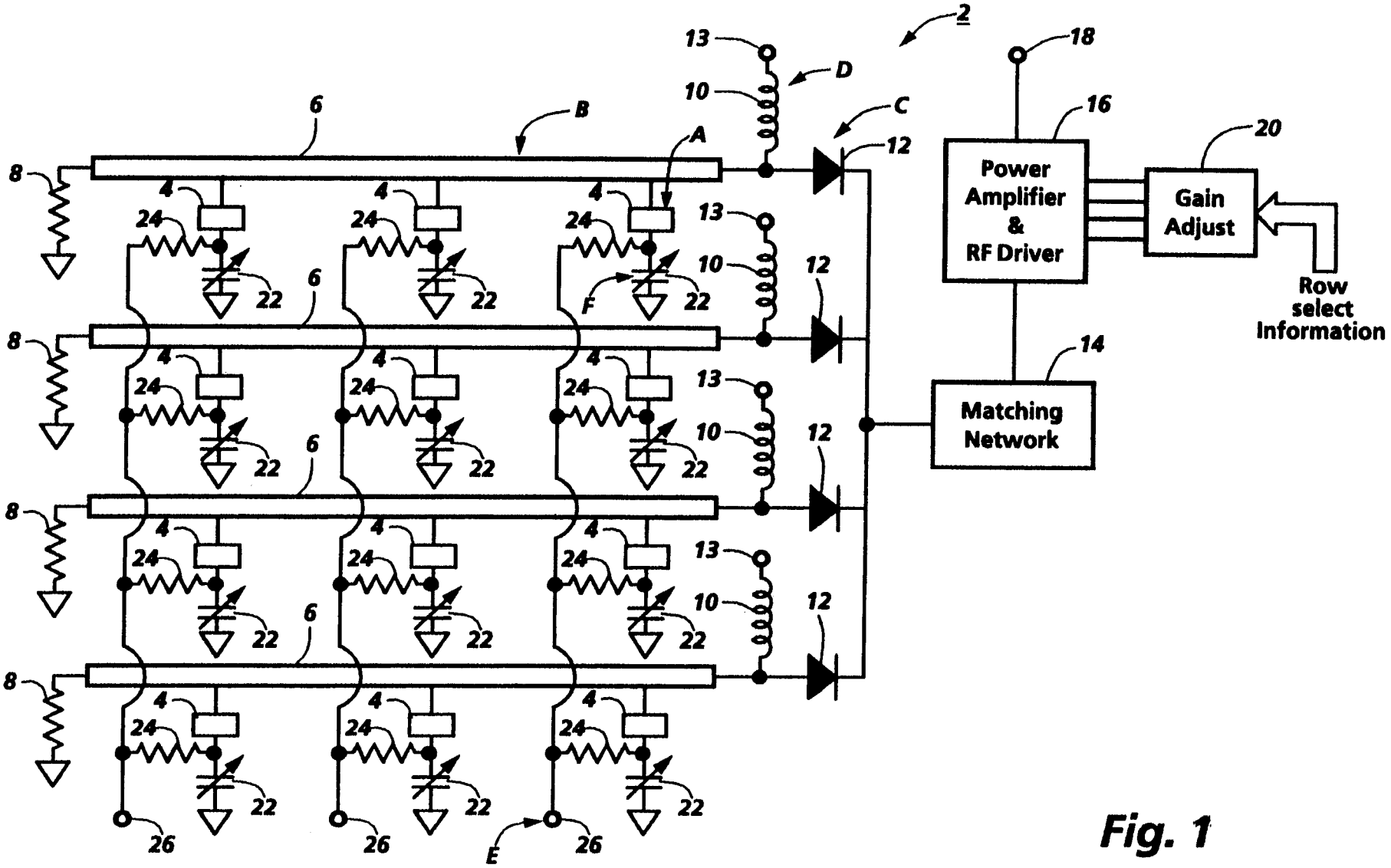
FIG. 1 is a simplified schematic depiction of a droplet ejector network according to one embodiment of the present invention.

Refer now to FIG. 1, where a simplified schematic depiction of a droplet ejector array network 2 according to one embodiment of the present invention is shown. The droplet ejector array network 2 includes a plurality of transducers 4 connected to one of several row conductors 6. Each row conductor terminates at one end with a terminating resistor 8, and at the other to a row select inductor 10 and to the anode of a PIN diode 12. The other terminals of the row select inductors, shown as nodes 13, are switchably connected (the switch network not shown for clarity) between a negative voltage—the unswitched state—and ground: the PIN diodes 12 are normally reverse-biased. The cathodes of the PIN diodes connect to the output of a matching network 14. The matching network 14 impedance matches its input, the output of a power amplifier and RF driver 16, to the above mentioned components. The inputs to the power amplifier and RF driver 16 include an RF input signal, applied on a line 18, and one or more gain control signals from a gain adjust circuit 20. The gain adjust circuit receives row select information that identifies the row from which a droplet is to be ejected. Also as shown in FIG. 1, each transducer 4 connects to an associated varactor 22 (shown as a variable capacitor) and a varactor resistor 24. The other terminals of the'varactor resistors are interconnected into columns addressable by column select lines 26.

To reduce row-to-row variations in an average droplet characteristic (each row may have several thousand droplet ejectors), the electric power applied to each row is controlled so that the average droplet from each row is substantially the same. This technique is referred to as central power control. Central power control is performed in FIG. 1 by varying the amplification (or the attenuation) of the power amplifier and RF driver 16 according to the output of the gain adjust circuit 20. Specifically, the gain adjust circuit 20 decodes its input row select information (which specifies from which row a droplet is to be ejected), and applies the proper gain adjust signal or signals to the power amplifier and RF driver 16. Of course, the proper gain adjust signals to achieve the desired result must first be determined and stored in the gain adjust circuit. This is beneficially performed shortly after fabrication and row interconnection of the individual droplet ejectors by: (1) measuring each row's average droplet characteristic, (2) determining how the input electric power affects each row's average droplet characteristic, (3) specifying the desired average droplet characteristic, (4) determining the proper signals to achieve the amplification (or attenuation) factor needed to obtain the desired average droplet characteristic for each row, and (5) storing the proper signals in the gain adjust circuit so that they can be recalled and applied to the power amplifier and RF driver 16 as required.

An example of droplet ejection using central power control may be helpful. Suppose that a droplet is to be ejected from a particular droplet ejector, say that associated with the transducer labeled A. The associated row (labeled B) becomes active by removal of the reverse-biasing on the associated PIN diode (labeled C) by switching the voltage at the node 13 labeled D to ground. That a droplet ejector in row B is to eject a droplet is identified by the gain adjust circuit 20 by decoding of row select information supplied by associated circuitry. The proper gain control signals to produce an average droplet with the proper characteristic from row B are recalled and applied by the gain adjust circuit to the power amplifier and RF driver 16. The gain of the power amplifier and RF driver is adjusted, and the proper RF power is launched down the row conductor B. Assuming that the required column voltage is contemporaneously applied to the column select line 26 labeled E, the capacitance of the associated varactor F becomes proper to enable the transducer A to generate acoustic energy to eject a droplet with the desired characteristic.

Figure 2:
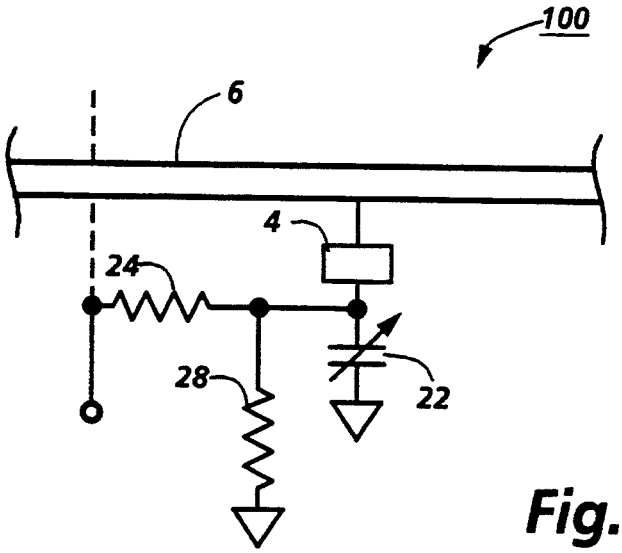
FIG. 2 is an expanded view of a droplet ejector and several components suitable for trimming.

Another technique for improving droplet uniformity is to adjust the efficiency of the individual droplet ejectors by physical trimming of their associated components. This technique is referred to as physical trimming. Refer now to FIG. 2, which shows several components of an isolated droplet ejector 100. The components in FIG. 2 are similar to, and perform the same functions as, like numbered components in FIG. 1. However, FIG. 2 shows an additional, optional shunt resistor 28 in parallel with the varactor 22. The varactor resistor 24 and the shunt resistor 28, if used, are advantageously cermet thin film resistors integrated close to their associated transducer 4. Physical trimming, such as with a laser, any of the components in FIG. 2 will change the efficiency of the droplet ejector 100, and thus the characteristics of its ejected droplet. Specifically, trimming the dimensions of the transducer 4 reduces its output acoustic energy. Trimming of the dimensions of the varactor reduces its capacitance (at a given voltage). Trimming the length of the series or shunt resistors, resistors 24 and 28 respectively, decreases their resistance, while trimming their width increases their resistance. By proper trimming of one or more of the components, the efficiency of the droplet ejector is set so that the desired droplet characteristic is achieved.

Figure 3A:
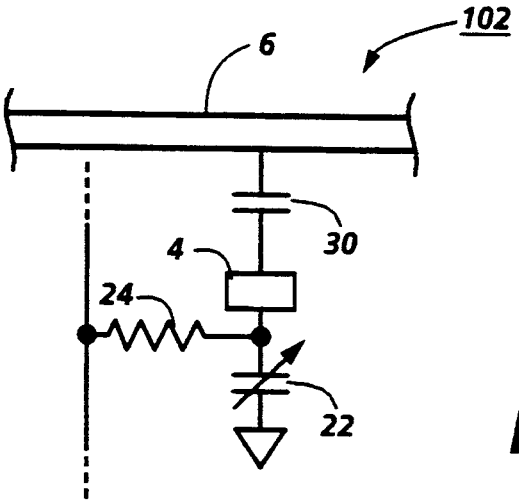
FIGS. 3A and 3B are expanded views of a droplet ejector having alternative components suitable for trimming.
Figure 3B:
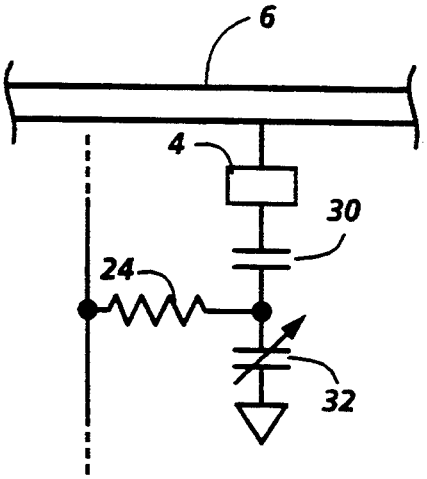

FIGS. 3A and 3B shows an isolated droplet ejector 102 having a capacitor 30 in series (in two different locations) with the transducer 4. The capacitor 30, not shown in FIGS. 1 or 2, is particularly well suited for trimming if it is externally exposed to the trimming device. The capacitor 30 is beneficially fabricated above the transducer 4 (FIG. 3 A) or above the varactor 22 (FIG. 3 B) so that its top electrode (plate) is readily accessible for trimming.

Yet another technique for improving droplet uniformity, referred to as electronic trimming, is to control the voltage applied to the varactor of each droplet ejector. This controls the efficiency of droplet ejection. Beneficially this is performed by controlling the voltage applied to the column select lines 26 (previously referred to and shown in FIG. 1). Since the voltage applied to a column select line affects the efficiency of all of the droplet ejectors in that column, the average droplet characteristic from each column can be controlled by the column select line voltages.

Figure 4:
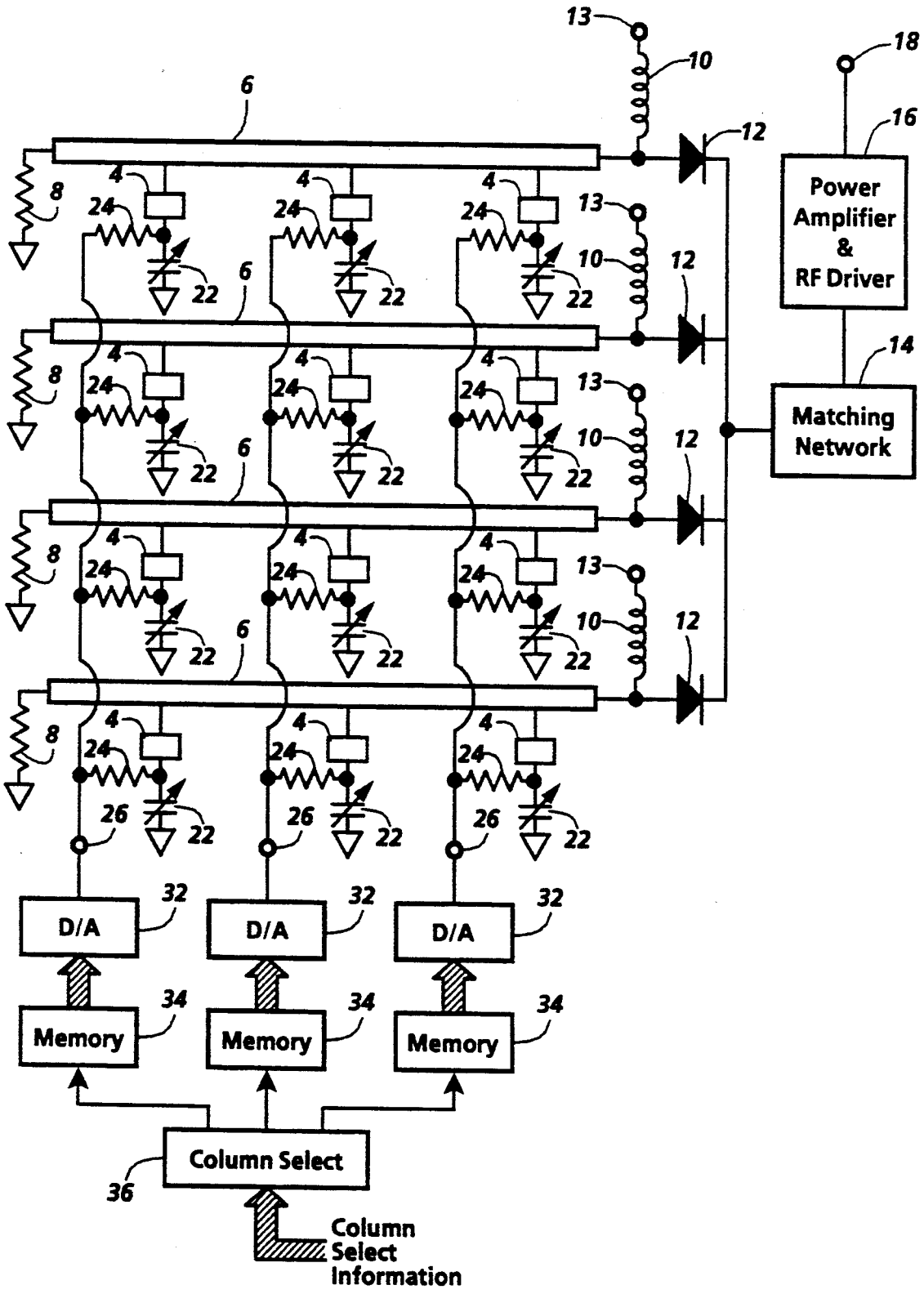
FIG. 4 is a simplified block diagram of a droplet ejector network which improves droplet uniformity using voltage trimming.

FIG. 4 helps explain electronic trimming. The column select lines 26 are connected to an associated digital-to-analog (D/A) converter 32 (beneficially fabricated in large quantities on IC chips). The output voltage of each D/A converter 32 is specified by data from an associated memory 34. One method of using the D/A converters to improve droplet uniformity is to program each memory 34 to contain data derived from an average droplet characteristic of the droplets from its associated column. By proper selection of the memory data, the average droplet characteristic from each column is made substantially uniform in much the same way as central power control improves row-wise uniformity.

Memory data is beneficially determined after production and interconnection of the individual droplet ejectors into columns, but before final assembly. Data determination includes the steps of (1) determining the average droplet characteristic for each column, (2) determining how the output of each D/A converter affects the average droplet characteristic of its associated column, (3) specifying the desired average droplet characteristic, (4) determining the proper data for each memory to achieve the desired average droplet characteristic from its associated droplet ejector, and (5) storing the required data in each memory to achieve the desired average droplet characteristics. Then, whenever a droplet is to be ejected, a column select network 36 decodes the column select signals supplied by associated circuitry and (which specifies the column from which a droplet is to be ejected) and sends an enabling signal to the appropriate memory 34. That memory then applies its stored code to its associated D/A converter 32, which causes the proper voltage to be applied to its column select line 26.

The above described voltage trimming method improves the droplet uniformity between columns. It is particularly beneficial since experiments suggest that droplet non-uniformity between columns is often greater than that between rows. However, combining central power control and voltage trimming provides an especially effective approach to achieving droplet uniformity. Central power control improves the average droplet uniformity between rows while voltage trimming improves the average droplet uniformity between columns.

Figure 5:
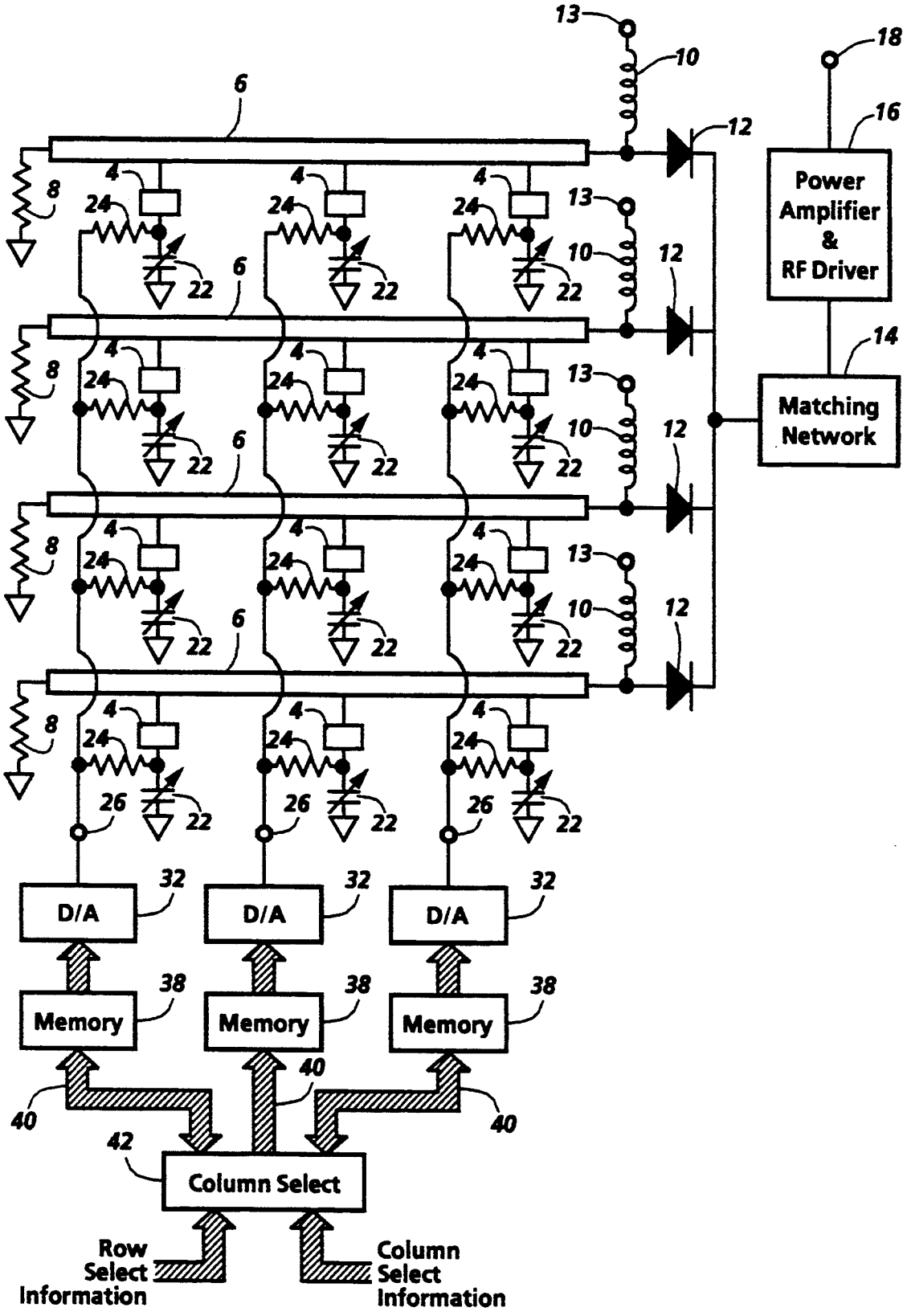
FIG. 5 is a simplified block diagram of an alternative droplet ejector network which improves droplet uniformity by using voltage trimming.

Voltage trimming may also be implemented in another, somewhat more complex, fashion that advantageously provides direct control of the efficiency of each ejector. Beneficially, this permits direct control of the characteristic of the droplets from each droplet ejector while also reducing the difficulty of subsequent compensation for component aging. This method is explained with the assistance of FIG. 5. As in the network illustrated in FIG.4, the D/A converters 32 apply their outputs to their associated column select lines 26 so as to control the efficiency of the ejecting droplet ejector. Now however, the voltages applied to the column select lines 26 are controlled so that each droplet ejector produces droplets with the proper characteristic. This requires that the proper digital code be applied to the appropriate D/A converter 32 to cause it to produce the proper voltage.

The codes that control the D/A converters are stored in memories 38. These codes are beneficially determined by (1) determining the droplet characteristic for each droplet ejector, (2) determining how the outputs of the D/A converters affect the droplet characteristic of each droplet ejector, (3) specifying the desired droplet characteristic, (4) determining the proper data for each droplet ejector to achieve the desired droplet characteristic, and (5) storing the proper data in the associated memory 38 so that the proper code is applied to the associated D/A converter to achieve the desired droplet characteristic.

Because each memory 38 stores a separate code for each droplet ejector in its associated column, the memories 38 must store more codes than the corresponding memories 34 (see FIG. 4). To select the code to apply to their associated D/A converter 32, the memories 38 receive droplet ejector select signals via buses 40 from a memory logic network 42. The memory logic network 42 (similar to the associated column select network 38 in FIG. 4) decodes both row select and column select signals so that the ejecting droplet ejector is identified.

From the foregoing, numerous modifications and variations of the principles of the present invention will be obvious to those skilled in its art. Therefore the scope of the present invention is to be limited only by the scope of the appended claims.

What is claimed is:

1. A method for improving the uniformity of droplets ejected from an array of droplet ejectors defining a first row and a second row of droplet ejectors which eject droplets in response to electrical inputs, the method comprising the steps of:

(a) determining for said first row of droplet ejectors a relationship between the electrical inputs to the droplet ejectors of said first row of droplet ejectors and an average characteristic of droplets ejected from said first row of droplet ejectors;

(b) determining for said second row of droplet ejectors a relationship between the electrical inputs to the droplet ejectors of said second row of droplet ejectors and an average characteristic of droplets ejected from said second row of droplet ejectors;

(c) specifying for said first row of droplet ejectors an average characteristic of droplets that are to be ejected by the droplet ejectors in said first row of droplet ejectors;

(d) specifying for said second row of droplet ejectors an average characteristic of droplets that are to be ejected by the droplet ejectors in said second row of droplet ejectors;

(e) determining for said first row of droplet ejectors, using steps (a) and (c), an amplitude of the electrical inputs to said first row of droplet ejectors that achieves the specified average characteristic for the droplets to be ejected from said first row of droplet ejectors;

(f) determining for said second row of droplet ejectors, using steps (b) and (d), an amplitude of the electrical input to said second row of droplet ejectors that achieves the specified average characteristic for the droplets to be ejected from said second row of droplet ejectors;

(g) applying to said first row of droplet ejectors the electrical inputs determined in step (e) when a droplet is to be ejected from said first row of droplet ejectors; and (h) applying to said second row of droplet ejectors the electrical inputs determined in step (f) when a droplet is to be ejected from said second row of droplet ejectors wherein droplet uniformity is improved.

2. A method for improving the uniformity of droplets ejected from an array of droplet ejectors defining a first and a second column of droplet ejectors which eject droplets in response to electrical inputs, the method comprising the steps of:

(a) determining for said first column of droplet ejectors a relationship between the electrical inputs to the droplet ejectors of said first column of droplet ejectors and an average characteristic of droplets ejected from said first column of droplet ejectors;

(b) determining for said second column of droplet ejectors a relationship between the electrical inputs to the droplet ejectors of said second column of droplet ejectors and an average characteristic of droplets ejected from said second column of droplet ejectors;

(c) specifying for said first column of droplet ejectors an average characteristic of droplets that are to be ejected by the droplet ejectors in said first column of droplet ejectors;

(d) specifying for said second column of droplet ejectors an average characteristic of droplets that are to be ejected by the droplet ejectors in said second column of droplet ejectors;

(e) determining for said first column of droplet ejectors, using steps (a) and (c), an amplitude of the electrical inputs to said first column of droplet ejectors that achieves the specified average characteristic for the droplets to be ejected from said first column of droplet ejectors;

(f) determining for said second column of droplet ejectors, using steps (b) and (d), an amplitude of the electrical inputs to said second column of droplet ejectors that achieves the specified average characteristic for the droplets to be ejected from said second column of droplet ejectors;

(g) applying to said first column of droplet ejectors the electrical inputs determined in step (e) when a droplet is to be ejected from said first column of droplet ejectors; and (h) applying to said second column of droplet ejectors the electrical inputs determined in step (f) when a droplet is to be ejected from said second column of droplet ejectors wherein droplet uniformity is improved.

3. A printer having a plurality of individual droplet ejectors organized into a plurality of rows, each row of said plurality of rows having a plurality of droplet ejectors, wherein a particular droplet ejector ejects a droplet when both a first electrical input is applied to a row containing the particular droplet ejector and a second electrical input is applied to the particular droplet ejector, the printer further comprising:

means for applying the first electrical input to said row containing the particular droplet ejector;

means for adjusting said first electrical input in response to gain adjust data associated with said row;

means for applying the second electrical input to the particular droplet ejector;

means for storing gain said adjust data associated with said row, wherein said gain adjust data is derived from a relationship between said first electrical input applied to said row and an average characteristic of droplets ejected by said droplet ejectors of said row; and means for applying said gain adjust data associated with said row to said adjusting means when the droplet is to be ejected by the particular droplet ejector.

4. A printer having a plurality of individual droplet ejectors organized into a plurality of columns, each column of said plurality of columns having a plurality of droplet ejectors wherein a particular droplet ejector ejects a droplet when both a column input is applied to a column containing the particular droplet ejector and a row electrical input is applied to the particular droplet ejector, the printer further comprising:

means for applying the column input to the column containing the particular droplet ejector;

means for adjusting the column input in response to column adjust data associated with said row;

means for applying the row electrical input to the particular droplet ejector;

means for storing column adjust data associated said column, wherein said column adjust data is derived from a relationship between said column input applied to said column and an average characteristic of droplets ejected by said droplet ejectors of said column; and means for applying said column adjust data associated with said column to said adjusting means when the droplet is to be ejected by the particular droplet ejector.

5. A printer having a plurality of individual droplet ejectors, each individual droplet ejector of said plurality of droplet ejectors ejects a droplet in response to an applied first electrical input, and each individual droplet ejector of said plurality of droplet ejectors includes a varactor which controls a characteristic of a droplet ejected from a particular individual droplet ejector in response to an applied second electrical input, the printer comprising:

means for applying said first electrical input to a particular individual droplet ejector;

means for recalling control data associated with said particular individual droplet ejector when said first electrical input is applied to said particular individual droplet ejector, said control data based upon a relationship between said second electrical input to said particular individual droplet ejector and an average characteristic of droplets ejected by said plurality of droplets ejectors;

means for converting said recalled control data to said second electrical input; and means for applying said second electrical input to said varactor of said particular individual droplet ejector.

6. A printer comprising:

means for producing a first electrical input;

a plurality of individual droplet electors, each having a transducer for converting said first electrical input into acoustic energy and an efficiency control means for controlling the efficiency of said conversion in response to an applied control signal;

row forming means for interconnecting said plurality of droplet electors into a plurality of rows of droplet electors such that said first electrical input can be applied to said transducer of each droplet ejectors such that a control signal can be applied to said efficiency control means of each of said droplet ejectors in each of said plurality of rows;

row select means for applying said first electrical input to a selected row of said plurality of rows;

control signal means for producing a set of row dependent control signals for adjusting the efficiency of the droplet electors in the selected row so that an average characteristic of droplets ejected by the selected row is substantially the same as an average characteristic of droplets ejected by a remainder of said plurality of rows of droplet ejectors; and means for applying a flow of dependent control signal associated with said selected row as the applied control signal to said efficiency control means of said droplet ejectors of said selected row.

7. The printer according to claim 6 wherein said efficiency control means includes a varactor.

8. A printer comprising:

means for producing a first electrical input;

a plurality of individual droplet ejectors, each of said plurality of individual droplet ejectors having a transducer for converting said first electrical input into acoustic energy and an efficiency control means for controlling the efficiency of said conversion in response to an applied control signal;

array forming means for interconnecting said plurality of droplet ejectors into an array of rows and columns of droplet ejectors such that said first electrical input can be applied to said transducer of each of said droplet ejectors in a row, and such that a control signal can be applied to said efficiency control means of each of said droplet ejectors in a column;

row select means for applying said first electrical input to a selected row of said array;

control signal means for producing a set of column dependent control signals for adjusting the efficiency of the droplet ejectors in a selected column so that an average characteristic of the droplets ejected by the droplet ejectors of said selected column is substantially the same as an average characteristic of the droplets ejected by droplet ejectors of a remainder of said columns; and column select means for applying a column dependent control signal associated with said selected column to the efficiency control means of the droplet ejectors of said selected column.

9. The printer according to claim 8 wherein said efficiency control means includes a varactor.

10. A printer comprising:

means for producing a first electrical input;

a plurality of individual droplet ejectors, each of said droplet ejectors having a transducer for converting said first electrical input into acoustic energy and a varactor for controlling the efficiency of said conversion in response to an applied control signal;

control signal means for producing a set of droplet ejector dependent control signals, for adjusting the applied control signal to the varactor of an associated droplet ejector so that a characteristic of the droplets ejected by said associated droplet ejector is substantially the same as droplets ejected by a remaining set of droplet ejectors; and ejector select means for applying said first electrical input and a droplet ejector dependent control signal to the associated droplet ejector.

* * * * *